US009503824B2

(12) United States Patent
Kinsbergen et al.

(10) Patent No.: US 9,503,824 B2
(45) Date of Patent: Nov. 22, 2016

(54) METHOD FOR ADJUSTING PARAMETERS OF A HEARING AID FUNCTIONALITY PROVIDED IN A CONSUMER ELECTRONICS DEVICE

(71) Applicant: JACOTI BVBA, Wevelgem (BE)

(72) Inventors: Jacques Kinsbergen, Boechout (BE); Joachim Neumann, Barcelona (ES); Nicolas Wack, Barcelona (ES); Nun Mendez Rodriguez, Barcelona (ES); Andrzej Zarowski, Wilrijk (BE)

(73) Assignee: JACOTI BVBA, Wevelgem (BE)

( * ) Notice: Subject to any disclaimer, the term of this patent is extended or adjusted under 35 U.S.C. 154(b) by 21 days.

(21) Appl. No.: 14/431,933

(22) PCT Filed: Sep. 27, 2013

(86) PCT No.: PCT/EP2013/070270

§ 371 (c)(1),
(2) Date: Mar. 27, 2015

(87) PCT Pub. No.: WO2014/049148

PCT Pub. Date: Apr. 3, 2014

(65) Prior Publication Data

US 2015/0256942 A1 Sep. 10, 2015

Related U.S. Application Data

(60) Provisional application No. 61/706,229, filed on Sep. 27, 2012.

(51) Int. Cl.
*H04R 25/00* (2006.01)

(52) U.S. Cl.
CPC ..... *H04R 25/30* (2013.01); *H04R 25/70* (2013.01)

(58) Field of Classification Search
CPC .... H04R 25/30; H04R 25/70; H04R 25/558; H04R 25/554
USPC ..... 381/315
See application file for complete search history.

(56) References Cited

U.S. PATENT DOCUMENTS

| | | | | |
|---|---|---|---|---|
| 7,660,426 | B2 | 2/2010 | Hannibal et al. | |
| 9,210,519 | B2 * | 12/2015 | Callias | H02J 7/345 |
| 2008/0226089 | A1 | 9/2008 | Levanoni et al. | |
| 2010/0064259 | A1 | 3/2010 | Alexanderovitc et al. | |

(Continued)

FOREIGN PATENT DOCUMENTS

| | | | |
|---|---|---|---|
| EP | 2375786 | A1 | 10/2011 |
| WO | 2012066149 | A1 | 5/2012 |

OTHER PUBLICATIONS

Boretzki et al., "The Benefits of Nonlinear Frequency Compression for People with Mild Hearing Loss," Audiology Online, URL:www.audiologyonline.com/articles, Nov. 23, 2009, downloaded on Mar. 26, 2015.

(Continued)

*Primary Examiner* — Brian Ensey
(74) *Attorney, Agent, or Firm* — Workman Nydegger

(57) ABSTRACT

A method for adjusting a parameter on a consumer electronics device is arranged for outputting a hearing loss compensated signal having a plurality of parameters. The consumer electronics device comprises processing means arranged for processing an audio input signal and for generating an audio output signal which is a hearing loss compensated version of the audio input signal. The method comprises producing with the consumer electronics device the audio output signal to be presented to a user. A rotation applied to the consumer electronics device such that the rotation is in a first direction in a substantial horizontal plane and, adjusting at least one parameter relates to the audio output signal's dynamic range, whereby the rotation in the first direction corresponds to a reduction of the dynamic range and a rotation in a direction opposite to the first direction to an increase of the dynamic range, or vice versa.

18 Claims, 2 Drawing Sheets

(56) References Cited

U.S. PATENT DOCUMENTS

| | | | | |
|---|---|---|---|---|
| 2011/0044483 | A1* | 2/2011 | Edgar | H04R 25/558 381/314 |
| 2011/0051964 | A1 | 3/2011 | Balke et al. | |
| 2011/0202111 | A1 | 8/2011 | Dillon et al. | |
| 2011/0299709 | A1* | 12/2011 | Anderson | A61B 5/121 381/315 |

OTHER PUBLICATIONS

International Search Report for corresponding International PCT Application PCT/EP2013/070270, Dec. 5, 2013.

Wikipedia, "One-Time Password," URL:http://en.wikipedia.org/wiki/One-time_password, downloaded on Mar. 26, 2015.

* cited by examiner

METHOD FOR ADJUSTING PARAMETERS OF A HEARING AID FUNCTIONALITY PROVIDED IN A CONSUMER ELECTRONICS DEVICE

FIELD OF THE INVENTION

The present invention is generally related to the field of consumer devices adapted for hearing impaired users. More in particular, it is related to techniques for parameter adjustment of the hearing aid functionality in such devices by the user.

BACKGROUND OF THE INVENTION

The signal processing in hearing aids aims at compensating hearing loss as well as improving speech intelligibility and sound quality. Digital hearing aids have a large number of parameters that define signal processing details. While hearing aid manufacturers define default values for a large number of parameters in an attempt to provide benefit to a majority of hearing impaired users, some of these values are not optimal for all users and all listening situations. The quest for optimal parameters often implies compromises, for example between listening comfort and speech intelligibility. Examples of parameters that can be personalized include:

the sound amplification as function of frequency, even after applying a fitting rule that converts the audiogram into a gain prescription, further individual adjustments are needed, the value of the time constants of the level detector in the automatic gain control, e.g., according to the user's age with a preference for longer time constant with growing age, the aggressiveness of the dynamic range compression, e.g., according to the need to hear soft sounds and to the sensitivity of the user to loud sounds, settings of the directional microphone, e.g., for users that need help in work-related meeting situations.

In conventional hearing aids, after the fitting process has been completed, typically at most two parameters are accessible to the hearing impaired user: the volume control of the instrument and a switch that allows selecting a listening program. All other parameters need to be set during the fitting process. This is traditionally done by a hearing professional according to the user feedback. In this process, the hearing impaired user might be listening to some sample sounds and the expert can ask the user a few questions. In addition, the result of diagnostic measurements is helpful, especially at the beginning of the fitting process when a first fit is done. These diagnostic tools include the user's hearing thresholds or audiogram (taking the air-bone gap into account), the user's most comfortable sound output level, the user's discomfort threshold and the result of various speech intelligibility tests.

Similarly, implantable auditory systems have parameters that need to be adjusted to the bearer of the implant. Here the variation in sensitivity of the user is enhanced by side-effects of the process of implanting the device. Hence, the need for fitting—or self-fitting—is even greater. Self-fitting is an attractive alternative if the number of experts capable of fitting implantable auditory systems is limited, as may be the case e.g. in developing countries.

The approach of hearing aid fitting by an expert has some flaws: the fitting process is somewhat tedious, and it requires the user to go to a specialized place and have him listen to sometimes annoying sounds or answer questions about sound perception that lies in the past. This process is even harder when fitting young children, which might not have the discipline or the attention required to correctly carry out the complete fitting process.

Another flaw is that the fitting process is carried out in a quiet and controlled environment, which is not representative of real-world situations. Therefore, it can very well happen that the settings found by the fitting process work well in this quiet environment, but degrade quite significantly in the real life sound environment of the user.

The present invention is concerned with self-fitting, that is, techniques allowing a user to find the optimal parameters by himself, without the help from a trained expert/audiologist. Self-fitting needs to be an easy process that does not require any technical knowledge from the user. Most known approaches involve a simple graphical user interface with keyboard, mouse or touch input, on which a user is adjusting a small number of parameters while the user is listening to a predefined listening situation. Variations of this process include the comparisons of the result of two or more sets of parameters and recordings of listening situations from the acoustic environment of the hearing impaired user.

Application US2011/044483 relates to specialized gesture sensing for fitting hearing aids. It aims to overcome the need to use standard keyboard and mouse input devices in the fitting process. The approach allows some patient participation in the fitting process. The proposed solution employs devices that act on gestures the audiologist or patient can make. The gestures can for example be used to indicate which ear has a problem or to change the volume to louder/softer by holding the input device and tilting it up or down. However, the proposed self-fitting process is performed in a static way.

In U.S. Pat. No. 7,660,426 the hearing aid fitting is performed by means of a camera. However, this application is addressing the problem of a physical fit of the aid to the ear of the hearing impaired user.

Application US2011/202111 discloses an auditory prosthesis with a sound processing unit operable in a first mode in which the processing operation comprises at least one variable processing factor, which is adjustable by a user to a setting which causes the output signal of the sound processing unit to be adjusted according to the preference of the user for the characteristics of the current acoustic environment.

US2008/226089 relates to dynamic techniques for custom-fit ear hearing devices. The hearing device comprises motion and pressure sensors. The received sensor signals are analysed by a computer and based thereon a stress-and-motion map is created. A virtual hearing device model for optimal support and comfort is created based on the stress-and-motion map.

Conventionally, hearing aids are devices that are worn behind the ear, in the concha of the outer ear or in the ear canal. Recently, however, interest has arisen in an alternative approach to hearing aids based on consumer electronic devices such as a smartphones or portable music players. In this approach, the hearing loss compensation is realized in a consumer device and the sound is presented to the user by headphones or wirelessly though an earpiece. In WO2012/066149 such a personal communication device was already shown.

SUMMARY OF THE INVENTION

It is an object of embodiments of the present invention to provide for a consumer device that allows a user to adjust one or more parameters of a hearing aid functionality available on the device, whereby said one or more parameters relate to the dynamic range of the audio signal. It is a further object to provide for a method for carrying out said adjusting.

The above objective is accomplished by the solution according to the present invention.

In a first aspect the invention relates to a method for performing parameter adjustment on a consumer electronics device. The consumer electronics device is arranged for outputting a hearing loss compensated signal having a plurality of parameters. The consumer electronics device comprises an input for receiving an audio input signal and an output for outputting an audio output signal and comprises processing means arranged for processing the audio input signal and for generating the audio output signal, said audio output signal being a hearing loss compensated version of the audio input signal. The method comprises the steps of:

producing with the consumer electronics device the audio output signal to be presented to a user, sensing with the consumer electronics device a rotation applied to the consumer electronics device, said rotation being in a first direction in a substantial horizontal plane and, adjusting at least one parameter relating to the audio output signal's dynamic range, whereby the rotation in the first direction corresponds to a reduction of the dynamic range and a rotation in a direction opposite to the first direction to an increase of the dynamic range, or vice versa, producing with the consumer electronics device an updated audio output signal, said updated audio output signal having said at least one adjusted parameter reflecting the change to the dynamic range.

The proposed solution indeed allows for parameter adjustment by the user. The method of the invention is typically applied in the context of e.g. a meeting wherein a number of persons sit around a table. At least one of the participants is hearing impaired and is provided with a consumer electronics device according to this invention. This person has put the device on the table. By rotating the device the settings can be adjusted in view of the position of the person speaking. The rotation is reflected in an adapted setting of one or more parameters related to the dynamic range of the output signal.

In a preferred embodiment the at least one parameter is a knee point and/or a compression ratio of an automatic gain control.

In one embodiment the method further comprises a determining of a gain balance between left and right ear by iteratively performing the steps of the method.

In a preferred embodiment a step is performed of detecting a listening situation wherein said consumer electronics device is applied. This allows adapting one or more parameter settings of the hearing aid functionality during normal use while taking into account the actual environment wherein the device is employed.

In another embodiment the consumer electronics device comprises a directional microphone with a beamformer. In the method then advantageously a step is performed of adjusting the beamformer's directionality by moving the consumer electronics device towards or away from a person that is speaking.

In an advantageous embodiment more than one parameter is adjusted simultaneously.

In another aspect the invention relates to a consumer electronics device arranged for outputting a hearing loss compensated signal having a plurality of parameters. The consumer electronics device comprises an input for receiving an audio input signal and an output for outputting an audio output signal, processing means arranged for processing the audio input signal and for generating the audio output signal, said audio output signal being a hearing loss compensated version of the audio input signal, sensing means arranged for sensing a rotation applied to the consumer electronics device, said rotation being in a first direction in a substantial horizontal plane, whereby the processing means is adapted for adjusting at least one parameter relating to the audio output signal's dynamic range, whereby the rotation in said first direction corresponds to a reduction of the dynamic range and a rotation in a direction opposite to the first direction to an increase of the dynamic range, or vice versa.

In one embodiment the consumer electronics device comprises a directional microphone with a beamformer. Based on a sensed movement of the consumer electronics device towards or away from a person that is speaking, the processing means can adjust the beamformer's directionality.

Advantageously, the consumer electronics device comprises storage means for storing pieces of audio, said consumer electronics device further arranged for replaying the stored pieces.

In a preferred embodiment the consumer electronics device is further arranged for establishing a connection to the Internet.

In another embodiment the consumer electronics device contains a processing means comprising a first signal path provided with filtering means for filtering said audio input signal and a second signal path in parallel with said first signal path, said second signal path arranged for calculating a transfer function of said filtering means and passing filtering coefficients to said filtering means.

In one embodiment the consumer electronics device comprises a button on a touch screen arranged for confirming an adjusted parameter setting.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The above and other aspects of the invention will be apparent from and elucidated with reference to the embodiment(s) described hereinafter.

BRIEF DESCRIPTION OF THE DRAWINGS

The invention will now be described further, by way of example, with reference to the accompanying drawings, wherein like reference numerals refer to like elements in the various figures.

DETAILED DESCRIPTION OF ILLUSTRATIVE EMBODIMENTS

Figure 1:
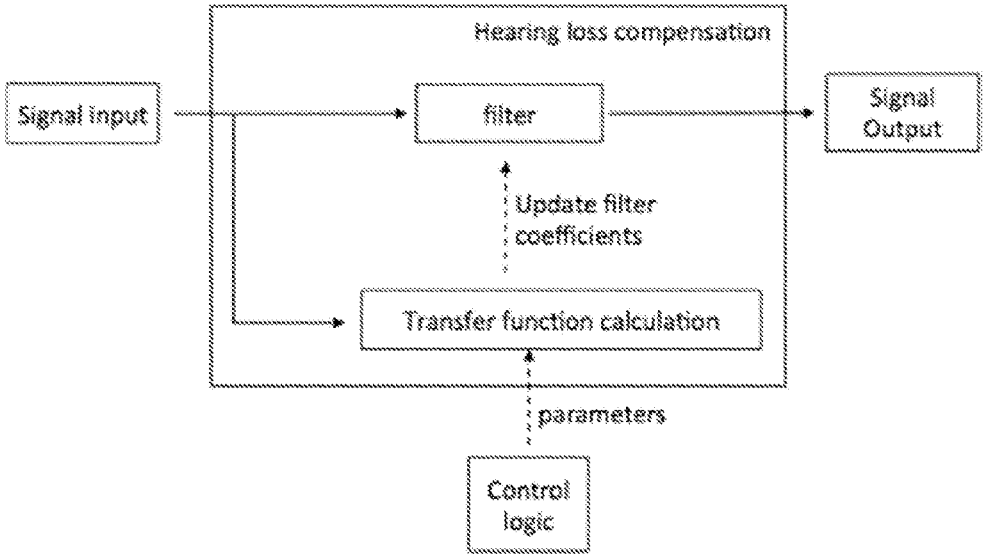
FIG. 1 illustrates a block scheme of a possible implementation of the software module for hearing loss compensation.

The present invention will be described with respect to particular embodiments and with reference to certain drawings but the invention is not limited thereto but only by the claims.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

It should be noted that the use of particular terminology when describing certain features or aspects of the invention should not be taken to imply that the terminology is being re-defined herein to be restricted to include any specific characteristics of the features or aspects of the invention with which that terminology is associated.

In the description provided herein, numerous specific details are set forth. However, it is understood that embodiments of the invention may be practiced without these specific details. In other instances, well-known methods, structures and techniques have not been shown in detail in order not to obscure an understanding of this description.

The present invention proposes a solution for realising adaptation of certain parameters by the user of the hearing aid functionality that has been provided in a consumer device. This consumer device may be a device as described in e.g. WO2012/066149. Allowing such self-fitting may be advantageous in several ways:

Hearing impaired users can improve the performance of their hearing aid without the direct intervention of a hearing expert. This is relevant if the user has no or limited access to a hearing professional due to economic limitations or due to the lack of experts in his proximity, e.g., in developing countries.

The hearing impaired user does not need to verbalize his problems with his current settings.

The time needed to evaluate a new setting can be reduced from the time between two visits to a hearing clinic to minutes or even seconds.

Self-fitting does not necessarily need to happen in fitting sessions. Instead, it might happen during the normal use of the device with the additional advantage that the self-fitting will improve the hearing aid in a listening situation that is relevant for the user.

The self-fitting process can optionally follow a first fit that relies on the result of a clinical diagnosis, but it might also be conducted without such a first step. Therefore, a clinical diagnosis is not necessarily required.

A gamified self-fitting procedure can be more appropriate for illiterate children and elderly people. These advantages will become more apparent from the description below.

The consumer electronics device of the present invention can take many possible forms. Any consumer communication device can be utilized as long as it allows for audio input (via built-in microphone or a line-in connector for external microphones or other means of audio input), comprises a programmable central processing unit with access to the sound signal, and provides audio output (a speaker, a line-out connector to connect ear buds or head phones or other means of audio output). In a preferred embodiment (rich) user interaction is possible, e.g. via a touch screen. Internet connectivity is also preferably available.

A software implemented hearing loss compensation module is provided in the processing means of the consumer electronics device for implementing the hearing aid functionality. In an advantageous embodiment the module is like the one described in international patent application WO2012/066149, which is hereby incorporated by reference in its entirety. Reference is made to FIG. 1. The hearing loss compensation module receives a digital input signal and a set of parameters. The set of parameters is calculated by a control logic block. Inputs of the control logic include, but are not limited to, user preferences, parameters received from a server through the Internet and information on the listening situation in which the consumer device is used, obtained through a secondary input, e.g., a microphone connected to the computer. Further audiological information based on audiograms or other audiological measurements may advantageously be exploited.

In this preferred embodiment a first signal path in the hearing loss compensation module (the audio path) is provided with filtering means (see FIG. 1) for filtering a digital audio signal input to generate a sound signal suitable to improve the sound quality and speech intelligibility for the hearing impaired user. The second signal path (the analysis path) works in parallel to the first signal path. The second signal path is receiving the input signal and determines the desired gain in one or more frequency bands. The second signal path can also receive the set of parameters as described above. The second signal path contains a module for transfer function calculation which determines the filter coefficients to be used in the filters in the first signal path based on the received set of parameters.

Consumer products as described above advantageously provide an Internet connection. In this case one can achieve additional benefit from the invention by exchanging data with a server. The data exchanged between the consumer device and the server can include a complete set of parameters that define the audio processing in the hearing loss compensation module. In addition, audio recordings and other metadata can be transmitted.

If such an Internet connection is provided, the solution according to the invention is able to use a server to:

allow hearing professionals to adjust parameters of the hearing loss compensation remotely in a remote fitting session between a hearing impaired user and an expert. This remote fitting session allows the hearing expert to help a hearing impaired user even if the user is not in the expert's physical proximity.

The rehabilitation process of implantable auditory prostheses can use a computer or a consumer device to allow the expert to use the Internet connection to help the rehabilitation by altering parameters of the sound in the consumer device or by changing the pre-processing or stimulation pattern generation in the implantable auditory prosthesis.

allow the user to synchronize parameters of the hearing loss compensation between multiple devices, either by an identification of the user (e.g., through a username and password) or by the usage of temporary one time passwords generated on one device and then used on a second device (http://en.wikipedia.org/wiki/One-time_password).

The user can upload audio signals to a server to allow a hearing expert to listen to a situation that is difficult to cope with for the hearing impaired user. The expert can then try to optimize the hearing loss compensation parameters to help in this specific situation.

The consumer device can automatically upload audio signals to a server. These include the audio signal processed in the second software module and can also include a sound signal of the listening situation of the hearing impaired user for an automatic classification. A classification of the listening situation can be used on the server to modify parameters of the hearing loss compensation in the device or the classification can be sent to the consumer device to allow applying local changes in the device to optimize the signal processing to the listening situation.

In contrast to conventional hearing aids, modern mobile devices have a large number of sensors and signals from most of these sensors can be accessed in apps that run on these devices. Many applications use these sensors to create a better gaming experience, navigation systems or multimedia applications. Applications exist that show raw data from the available sensors. The present invention proposes a method for performing self-fitting of a hearing aid functionality provided to such a consumer device by exploiting the availability of sensors in the device.

While most smartphones have both a touch screen and several of the above mentioned sensors, some low cost phones might have sensors, but not a touch screen. The sensor based hearing aid fitting can be possible with these phones. Also, in situations in which the user cannot use the touch screen (e.g., while driving), he could use the sensors to communicate to the hearing aid.

A non-exhaustive list of sensors and input modalities in consumer devices that can be used in self-fitting include:

The touch screen allows visualizing the state of one or more parameters and allows the user to manipulate these parameters directly with his finger. Parameters can be visualized and manipulated as a conventional slider or in another graphical representations of possibly more than one parameter, e.g., in the form of a two-dimensional field in which the user selects one point.

accelerometers and gyrometers allow capturing movements and gestures, which the user can execute with the device, either consciously using a gesture or unconsciously. Simple gestures such as flipping over the phone to silence the ringer or whacking the phone have been described outside the context of hearing aid fitting. More complex gestures such as pointing, sweeping the arm, tilting, lifting or lowering the phone can be used for more complex parameter adjustments.

depth sensing devices that can be used to capture the proximity of objects, or in more complicated set-ups, generate images where each point has a known distance from the sensor.

the compass allows determining the orientation of the device in a horizontal plane.

some sensors might actually not be inside the casing of the device, but rather somewhere else on the user and communicate to the device through a wireless body area network.

a combination of the above sensors allows registering relative movements in space, e.g, when placing the phone at specific locations on a table, measuring the distance of the phone from a starting position, etc.

the task of hearing aid fitting can be accelerated and improved if the user changes more than a single parameter at once. Such a simultaneous adjustment of more than one parameter can be facilitated with the help of the sensors.

gestures are intuitive and can be integrated in a playful interaction with the phone.

The use of sensors was already addressed in WO2012/066149. It is among other things described that information from sensors is applied in a so called situation analysis module to include the context of the actual listening situation in a situation analysis. The context is the combination of numerous sources of information such as meta-information about the location. Apart from the acoustic signal, the situation analysis also uses e.g. time, day of the week, location sensing information or information from an accelerometer or gyrometer for motion detection and classification One important requirement for the sensor based self-fitting is an easy and intuitive interaction with the system. Additionally, the security of the user needs to be ensured at all times. This is a critical requirement e.g. when the user is increasing the sound level during the self-fitting session. Any accidental gesture (such as dropping the phone) cannot result in a sudden increase of amplification.

The accelerometer provides direct access to a change in the device position. However, getting the absolute device position in the three dimensional space (e.g., where exactly on the table is the device?, how far is the device from the tip of my nose?) cannot be reliably derived from the accelerometer only. The techniques needed for absolute positioning in space involves continuous monitoring of the three accelerometer axes, the three gyroscope axes and the reading of the compass. The signals from these sensors need to be fed into algorithms able to infer the current position and orientation of the device, with respect to a start position. The redundancy of the sensors helps to increase the accuracy and to reduce the accumulation of errors. Possible start positions of the device include: a central position on a table, in the hand of the user, at the top of the head of the user, in the pocket of the user. Furthermore, the combination of said sensors with depth image sensors can dramatically improve the capabilities of location tracking of the device, as the depth information can also be fed to those algorithms, and even further, it enables the device to sense its environment, rather than only sensing its self-movement.

The signal processing in digital hearing aids (both conventional hearing aids and consumer device based hearing aids) is controlled by a large range of parameters. One of the most basic and also utterly important set of parameters controls the amount of amplification provided by the hearing aid. Similar parameters exist in the pre-processing in implantable auditory systems. This amplification is different across the frequency range of the hearing aid and is often parameterized as an array of gain values in dB for a set of frequencies, e.g., as gain at the audiogram frequencies 0.125, 0.25, 0.5, 0.75, 1, 1.5, 2, 3, 4, 6, and 8 kHz. In non-linear hearing aids, these gain values are not constant, but depend on the level of the listening situation. In order to provide the correct amount of gain for hearing impaired users with loudness recruitment (whereby more amplification is required in soft listening situations and less amplification in loud listening situations) and a reduced dynamic range, hearing aids provide less gain for increasing sound input levels, or, in the case of multi-channel automatic gain control hearing aids, for increasing sound input sound levels in the corresponding frequency region. This reduction of gain as function of input sound level is called dynamic range compression and can be characterized by a set of parameters, e.g., a knee point, a compression ratio and a maximal sound output level or alternatively, it can be characterized by a set of gain values for each frequency and each sound input level.

A fitting or self-fitting process aims is concerned with fine-tuning these parameters—both for the individual amplification need and for the type of listening situation (at work, at home, driving, etc.). Self-fitting can also be used to determine the optimal value of parameters such as a one-dimensional tone balance that changes the tonality of the sound by changing the relative gain between low and high frequencies parameters of the microphone noise reduction that provides less gain at very low sound input levels parameters of the noise reduction algorithm and parameters of the aggressiveness of the effect of the noise reduction, selection of situations in which the noise reduction is not desired parameters for an automatic program switch (if present)

parameters that control the aggressiveness of feedback cancellation (if present)

parameters of acoustic echo cancellation (feedback with longer time constants), e.g., during a VoIP telephony phone call (if present)

parameters of source separation, either blind or using spatial cues comparing the microphone signals from the two ears (if present).

The values obtained during the self-fitting can be applied directly to the hearing aid. However, a more flexible software architecture can involve a control logic unit that stores the values resulting from the self-fitting process. As described in WO2012/066149, the control logic is also adapted for receiving input from a hearing professional and from the server. It may as well receive a description of the current listening situation. Based on all of this data, the control logic decides on the optimal parameter values. In addition, a server that is connected to the hearing aid is able to compare the desired amplification from all users for a global cross-user fitting procedure. This idea of cross-user fitting is that one can obtain a better hearing aid fitting by looking at the parameters provided to users with a similar hearing loss (audiogram)—or—from users that similarly adjust the most comfortable level in specific listening situations. This cross-user fitting procedure can help to overcome the cold start problem for new users. However, the optimal gain is something very individual and the variation between users with almost identical audiograms is considerable.

The self-fitting process can happen in well-defined self-fitting sessions in which the user is aware of being in a self-fitting session and in which the user listens to sounds that help determining the optimal parameters.

During a self-fitting fitting session, the user is presented with a well-defined audio signal. This can be a pre-recorded audio signal with known audio properties such as for example "speech in low frequent background noise" or "narrow band noise with most energy between 1000 and 1300 Hz" or it can be sound signals that the user has recorded himself, such as for example "typical speech signal during a meeting at work" or "my grandchildren talking to me". While the latter type of sound signals need to be analysed for their acoustic properties, they are often far more relevant to the user. The fitting system preferably allows the user to replay the recorded listening situations at a level that is realistic for the situation. An expert could be present during the self-fitting session, an expert could assist over the Internet or the user could conduct the self-fitting session without the help of an expert.

The system can also present a series of stimuli such as narrow band noise signals with spectral energy in a certain frequency range or pure tone signals or artificial words that obey the phonetic rules of a language, but have no meaning (as described in the paper '*The benefits of nonlinear frequency compression for people with mild hearing loss*', Boretzki and Kegel, available on www.audiologyonline-.com/articles). The user then uses gestures to indicate if the sound is too soft, too loud, relatively louder than another sound, easier or more difficult to understand, etc. The self-fitting system next presents a new stimulus and the selection of the new stimulus is based on the user's feedback. At the end of the fitting session, a control logic uses all information gathered during the self-fitting process to find an optimal set of parameters valid for all listening situations.

The self-fitting session can also include questions that are asked to the user, for example to rate how well he has understood what has been said.

Figure 2:
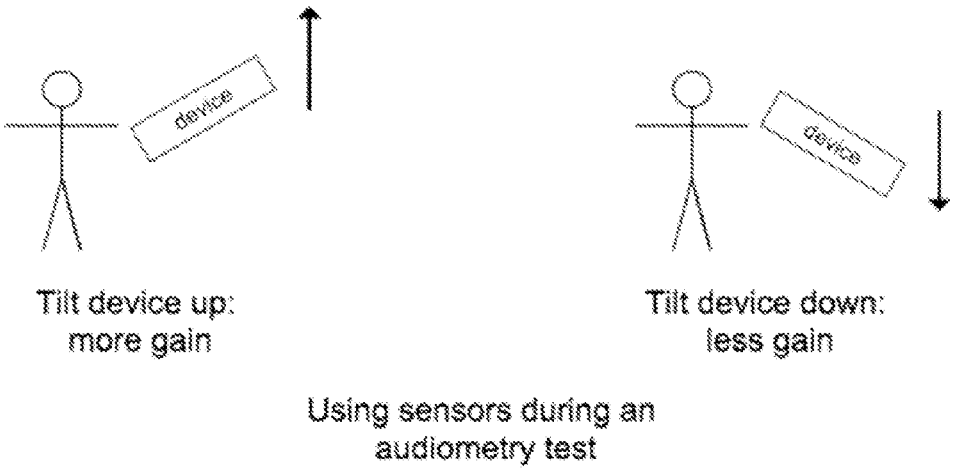
FIG. 2 illustrates the use of sensors during an audiometry test.

A similar procedure can also be used for diagnostics, for example for Békésy audiometry: one gesture that changes the horizontal orientation of the phone can change the frequency of a tone and another gesture such as the elevation of the phone can change the level of the tone. The user would then be able to draw his hearing threshold into the air. An example that accomplishes said objective is an exercise in which the user is asked to draw a path as high as he can without hearing anything on the device's headphone. In such method, the higher the hand of the user, the higher the volume of the tone the device is reproducing. To increase robustness and precision, the user can be asked to repeat the procedure several times, and even further, this procedure can be iteratively refined by focusing in the range of volumes the hearing threshold is expected to be according to previous iterations, allowing then for more fine-tuned adjustment of the gain. Similarly, the user can be asked not to adjust the sound level to his hearing threshold, but to rather set the sound level to his most comfortable sound level or to his uncomfortable level. In another approach, a calibration signal is presented and the user is asked to adjust the level of the stimuli of other frequencies to the same perceived sound level. FIG. 2 provides an illustration.

As an alternative to the session-based approach described above, the self-fitting can happen during the normal use of the hearing aid. In this scenario, the sound evaluated by the user stems from his normal environment and his adjustments are evaluated together with an analysis of the sound the user is hearing simultaneously with his adjustment or in the seconds just before his adjustment. In this scenario, the hearing aid can offer the user a recording of the last seconds to allow a repeated adjustment or to allow the user to listen to the same situation again with a new set of parameters.

The continuous self-fitting can also include questions asked to the user, for example to rate how well he has understood what has been said after a self-fitting adjustment.

In this approach the gestures of the user can change the acoustic stimulation directly. Such gestures can be more playful, more accurate and less tiring than a repetition of more simple binary choices during a self-fitting session. The gesture can change the frequency of the sound, its sound level, its spatial direction, its speech-to-noise ratio or any other property. One example can be the balance of gain between the right and left ear in which a gesture of the user changes this balance, e.g., by pointing to a certain direction relative to an initial orientation. The user might use another gesture or press a button on the touch screen to indicate that his parameter-adjusting gesture has created a desired sound quality.

In this continuous approach to self-fitting, the optimal set of parameters (e.g., gain values at each audiogram frequencies) strongly depend on the listening situation. For example, most hearing impaired users prefer less amplification in loud situations. But even if the set of parameters attempts to address all situations, e.g., by specifying an automatic gain control with a knee point and a compression ratio, the best values of these parameters depend on factors such as the presence of speech and the importance of the situation: the best parameters for having clear speech during a meeting at work do not necessarily have to be the same as those intended to be able to listen to birds in a park on a windy day.

Some of the problems that need to be addressed in continuous fitting include distinguishing between the movement of the arm while the user stays in place and a movement of the user as he starts walking, i.e.: one needs to differentiate between an absolute translation of the device in space and a relative displacement of the device with respect to the user. This can either be done by algorithms that analyse sensor data or by clear instructions to the user. During the measurement of the uncomfortable threshold, the procedure needs to prevent resulting output sound levels above the pain threshold of the user, e.g., due to an accidental or wrong gesture.

The procedure can involve the user making gestures that simultaneously adjust two or more parameters, for example when the user is asked to find the best (most comfortable, etc. . . . ) set of parameters on a two-dimensional area on the screen using the tilt of the phone (like in a ball maze game). This way of fitting could also be implemented using a touchscreen, or two sliders, but tilting the device might be more intuitive for elder people, and the playfulness associated with these controls could encourage young children to pay more attention to it. Such a gamification of self-fitting can both increase the motivation of hearing impaired users to endure a lengthy self-fitting process and help users that have problems to read written instructions or express their amplification need.

In order to test if the user is capable of reliably adjusting these parameters simultaneously, the procedure can compare the result of a repeated fitting task and verify that the user ends up at a similar position. A reliability test may be based on the consistency of the resulting parameter values and the procedure could instruct the user to seek help from an expert in the case of low reliability.

Apart from gestures that the user is realizing with the device, the device can be attached to some part of the body, e.g., the hands, arms or head. The gesture would then be executed naturally with this body part, e.g., by tilting the head or by pointing with the arm. Another possibility is that the user does not move the device at all, but stays in front of it and realizes gestures that are sensed by the device's camera or depth sensor.

Another approach tries to overcome the problem of the unpleasantness of the conventional hearing aid fitting process, by proposing the idea of unconscious fitting: the fitting should be conducted in a way that is not recognized by the user as such.

One way to achieve this is the following: if the user would seem to always lower the volume in a specific listening situation, this indicates a gain reduction in this type of situations.

Another way to achieve the same results would be to use a game with a purpose, or to apply gamification to the fitting process. This implies to use a game as the main activity, but the usage of which results in some data helping the fitting process. This is where the sensors come in: imagine a game where you hold your device as a gun. Whenever you hear a gunshot (spatialized at a known position), the instruction to the user is to point the device to where the sound came from. A constant discrepancy over time between the known location of the sound and where the device is pointed at could indicate problems with the relative amplification of the left and right ear, and in addition suggest how much the gain at one of the ears would need to be lowered or increased to fix this. We could also imagine a game where the user acts as an orchestra director, and the device can serve as a way to change the volume of the different instruments. This game be used to obtain information about the perception of timbre/pitch while listening to music. Another game based fitting procedure could involve the sensors of the device detecting the position of a child that is playing in the street. According to the position of the child on the street, the sound of the hearing aid would change, thus allowing the child to go to the position of best understanding. A mobile device could be comfortably in the pocket during this procedure.

Figure 3:
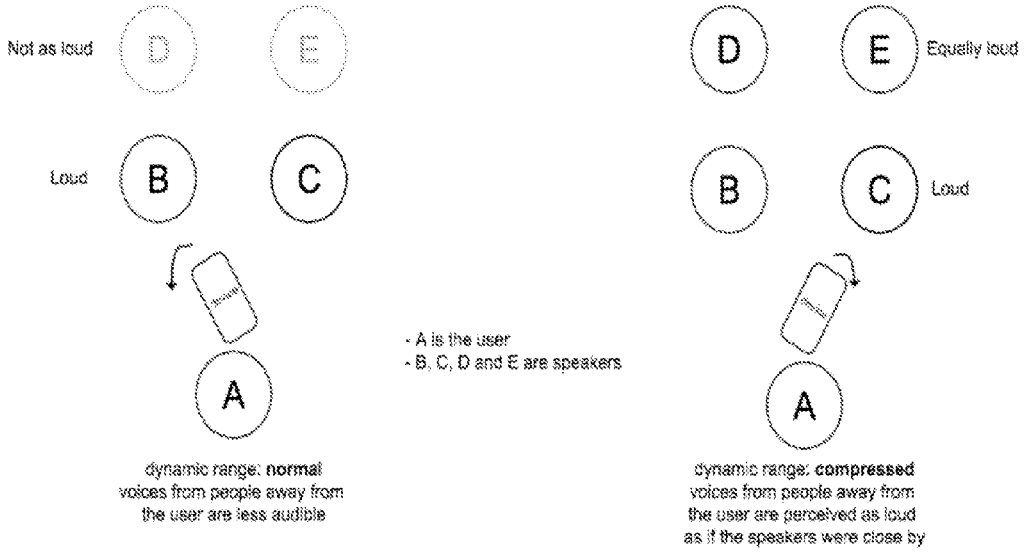
FIG. 3 illustrates an embodiment of the method according to the invention.

Some particularly interesting use cases are now described. A first application is typically found in a meeting room, where a number of people are present, sitting e.g. round a table. FIG. 3 gives an illustration. At least one of the meeting participants is hearing impaired and disposes of a consumer device as in the present invention. Suppose the consumer electronics device is a smartphone whereon a hearing loss compensation module has been programmed in software. The hearing impaired person has put his smartphone on the table. Parameters of the hearing loss compensation module can then be fitted in the following way. The user can rotate the phone horizontally, for instance clockwise to increase the compression ratio and/or the kneepoint of the AGC in order to reduce the dynamic range and make voices seem closer (e.g. someone at the other side of a room would sound louder). Rotating the phone counter-clockwise makes far voices sound lower, but at the benefit of a potential reduction in background noise. As this is done easily, it can be expected that people even use this feature continuously during the same meeting depending on the speaker and his relative position in the room. For instance, the user can turn the phone to adjust to every speaker individually continuously during the meeting, e.g.: speaker A talks, user turns the phone to the right as it sounds better. Speaker B talks, user turns the phone to the left, speaker A talks again and user turns phone to the right again, and so forth. This continuous adjustment is easy to perform and doesn't disturb the meeting, so it would be socially acceptable.

In the above-described use case the gain settings of the Automatic Gain Control are adapted by horizontal rotation of the smartphone. In this way the dynamic range that fits best the situation can be found.

Figure 4:
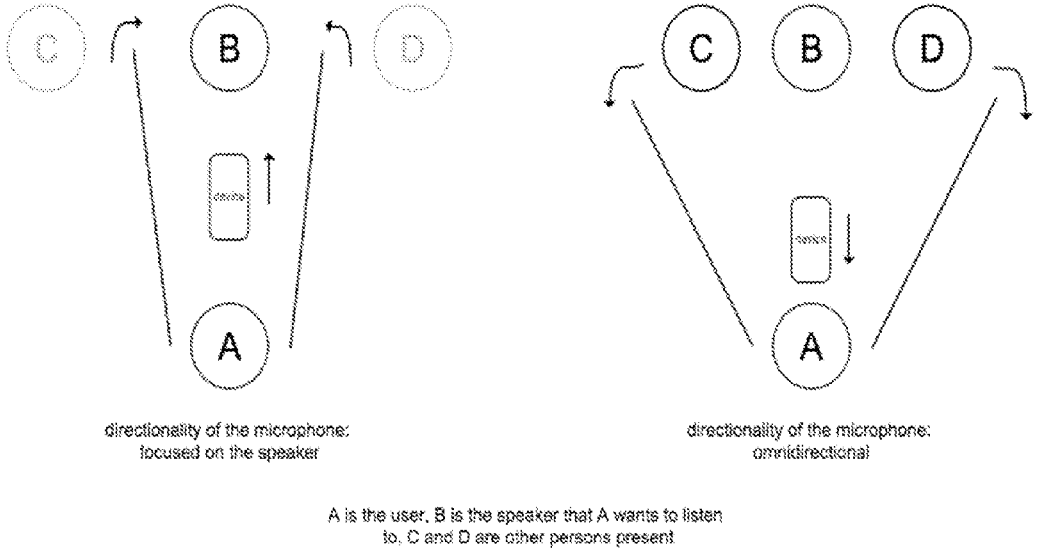
FIG. 4 illustrates an embodiment wherein the consumer electronics device comprises a directional microphone, the directionality of which is adjusted by sensing movement.

In case the consumer electronics device contains a directional microphone with a beam former it is possible to adjust the directionality of the beam former by moving the device away from the user or towards him. By such translation one can move the device closer to the speaker for a focused directionality on him, or further away from the speaker for a more omnidirectional beamforming. FIG. 4 shows an illustration.

In order to be able to find a correct balance between both ears, the system can play a sound that should be perceived to be as loud on both ears, and the user is asked to adjust the relative gain by tilting the device left or right in order to give more gain on the corresponding ear. Another type of sensor data that can be used in order to better adjust the balance between both ears is to play a sound or a melody and ask the user to point to the direction where the sound seems to be coming from. A difference from the expected direction can be interpreted as a lack of gain on one ear and as corresponding need for adjustment.

In a practical case where the above-mentioned consumer device is a pair of glasses numerous advantages are provided by implementing sensor based self-fitting. In case the glasses contain microphones mounted at ear level, they can be used to ask the user to turn his head to the most predominant source of sound available at any moment, so that the user hears the sound equally loud on both ears. Information about an unbalance between the ears can be diagnosed by looking at a constant bias of the intensity detected by the glasses' microphones. Furthermore, by carefully selecting the listening situation and the predominant sound characteristics (frequency, bandwidth, loudness, SNR, etc. . . . ), the system can end up with a very precise mapping of the user's response as a function of those parameters. It also provides a mean for continuous fitting as the user would be periodically asked and the data updated.

While the invention has been illustrated and described in detail in the drawings and foregoing description, such illustration and description are to be considered illustrative or exemplary and not restrictive. The foregoing description details certain embodiments of the invention. It will be appreciated, however, that no matter how detailed the foregoing appears in text, the invention may be practiced in many ways. The invention is not limited to the disclosed embodiments.

Other variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A method for parameter adjusting on a consumer electronics device, arranged for outputting a hearing loss compensated signal having a plurality of parameters, said consumer electronics device comprising an input for receiving an audio input signal and an output for outputting an audio output signal and comprising processing means arranged for processing said audio input signal and for generating said audio output signal, said audio output signal being a hearing loss compensated version of said audio input signal, the method comprising the steps of:

producing with said consumer electronics device said audio output signal to be presented to a user;

sensing with said consumer electronics device a rotation applied to said consumer electronics device, said rotation being in a first direction in a substantial horizontal plane; and, adjusting at least one parameter relating to said audio output signal's dynamic range, whereby said rotation in said first direction corresponds to a reduction of said dynamic range and a rotation in a direction opposite to said first direction to an increase of said dynamic range, or vice versa;

producing with said consumer electronics device an updated audio output signal, said updated audio output signal having said at least one adjusted parameter reflecting the change to said dynamic range.

2. The method for parameter adjusting as in claim 1, wherein said at least one parameter is a knee point and/or a compression ratio of an automatic gain control.

3. The method for parameter adjusting as in claim 1, comprising a determining of a gain balance between left and right ear by iteratively performing the steps of the method.

4. The method for parameter adjusting as in claim 1, wherein a step is performed of detecting a listening situation wherein said consumer electronics device is applied.

5. The method for parameter adjusting as in claim 1, wherein said consumer electronics device comprises a directional microphone with a beamformer and wherein a step is performed of adjusting said beamformer's directionality by moving said consumer electronics device towards or away from a person that is speaking.

6. The method for parameter adjusting as in claim 1, wherein more than one parameter is adjusted simultaneously.

7. A consumer electronics device arranged for outputting a hearing loss compensated signal having a plurality of parameters, said consumer electronics device comprising:

an input for receiving an audio input signal and an output for outputting an audio output signal;

processing means arranged for processing said audio input signal and for generating said audio output signal, said audio output signal being a hearing loss compensated version of said audio input signal;

sensing means arranged for sensing a rotation applied to said consumer electronics device, said rotation being in a first direction in a substantial horizontal plane;

wherein said processing means is adapted for adjusting at least one parameter relating to said audio output signal's dynamic range, whereby said rotation in said first direction corresponds to a reduction of said dynamic range and a rotation in a direction opposite to said first direction to an increase of said dynamic range, or vice versa.

8. The consumer electronics device as in claim 7, comprising a directional microphone with a beamformer, and arranged for adjusting said beamformer's directionality based on sensed movement of the consumer electronics device.

9. The consumer electronics device as in claim 7, comprising storage means for storing pieces of audio, said consumer electronics device further arranged for replaying said stored pieces.

10. The consumer electronics device as in claim 7, further arranged for establishing a connection to the Internet.

11. The consumer electronics device as in claim 7, wherein said processing means comprises a first signal path provided with filtering means for filtering said audio input signal and a second signal path in parallel with said first signal path, said second signal path arranged for calculating a transfer function of said filtering means and passing filtering coefficients to said filtering means.

12. The consumer electronics device as in claim 7, comprising a button on a touch screen arranged for confirming an adjusted parameter setting.

13. A consumer electronics device that outputs a hearing loss compensated signal having a plurality of parameters, said consumer electronics device comprising:

an input configured to receive an audio input signal and an output configured to output an audio output signal;

a processor configured to process said audio input signal and to generate said audio output signal, said audio output signal being a hearing loss compensated version of said audio input signal; and a sensor configured to sense a rotation applied to said consumer electronics device, said rotation being in a first direction in a substantial horizontal plane;

wherein said processor is configured to adjust at least one parameter relating to said audio output signal's dynamic range, whereby said rotation in said first direction corresponds to a reduction of said dynamic range and a rotation in a direction opposite to said first direction to an increase of said dynamic range, or vice versa.

14. The consumer electronics device as in claim 13, comprising a directional microphone with a beamformer, wherein said consumer electronics device is configured to adjust said beamformer's directionality based on sensed movement of the consumer electronics device.

15. The consumer electronics device as in claim 13, comprising a storage that stores pieces of audio as stored pieces, said consumer electronics device further configured to reply said stored pieces.

16. The consumer electronics device as in claim 13, wherein the consumer electronics device is configured to establish a connection to the Internet.

17. The consumer electronics device as in claim 13, wherein said processor comprises a first signal path and a second signal path, said first signal path being provided with a filter configured to filter said audio input signal and said second signal path being in parallel with said first signal path, said second signal path being configured to calculate a transfer function of said filter and to pass filtering coefficients to said filter.

18. The consumer electronics device as in claim 13, comprising a button on a touch screen configured to confirm an adjusted parameter setting.

* * * * *